US005238453A

United States Patent [19]

Heil

[11] Patent Number: 5,238,453

[45] Date of Patent: Aug. 24, 1993

[54] INTEGRAL PIVOT DAMPER BLADE

[75] Inventor: Eugene J. Heil, Marathon, Wis.

[73] Assignee: Greenheck Fan Corporation, Schofield, Wis.

[21] Appl. No.: 819,622

[22] Filed: Jan. 9, 1992

Related U.S. Application Data

[63] Continuation-in-part of Ser. No. 667,875, Mar. 12, 1991, abandoned.

[51] Int. Cl.[5] ..... F24F 13/14

[52] U.S. Cl. ..... 454/335; 137/601

[58] Field of Search ..... 137/601; 454/278, 318, 454/319, 325, 335

[56] References Cited

U.S. PATENT DOCUMENTS

| | | | |
|---|---|---|---|
| 1,643,192 | 9/1927 | Yeager | 98/110 |
| 1,817,836 | 8/1931 | Petrelli | 98/110 X |
| 3,123,098 | 3/1964 | Bishop | 454/318 X |
| 3,196,895 | 7/1965 | Dayus | 98/110 X |
| 3,270,657 | 9/1966 | Jaye | 98/110 |
| 3,605,603 | 9/1971 | McCabe | 98/110 |
| 3,982,560 | 9/1976 | Dibert | 251/338 |
| 4,080,978 | 3/1978 | McCabe | 137/79 |
| 4,081,173 | 3/1978 | McCabe | 251/308 |
| 4,103,601 | 8/1978 | Dayus | 98/121.2 X |
| 4,113,230 | 9/1978 | McCabe | 251/308 |
| 4,114,646 | 9/1978 | McCabe | 137/601 |
| 4,244,397 | 1/1981 | Magill et al. | 454/335 X |
| 4,294,283 | 10/1981 | Scharres | 137/601 |
| 4,338,967 | 7/1982 | McCabe | 137/601 |
| 4,404,990 | 9/1983 | McCabe | 137/601 |
| 4,487,214 | 12/1984 | Tatum | 137/72 |
| 4,518,012 | 5/1985 | O'Hara | 137/601 |
| 4,844,120 | 7/1989 | Myers | 137/601 |
| 4,887,641 | 12/1989 | Alley | 137/601 |

*Primary Examiner*—Harold Joyce

*Attorney, Agent, or Firm*—Quarles & Brady

[57] ABSTRACT

A damper blade is constructed with a laterally extending, rounded rib and with integral journals on opposite ends of the rib that form bearing surfaces when the blade is journaled in openings in the frame of a damper assembly. The construction provides for convenient manufacturing from a blank without the addition of hardware for mounting the blade in a damper assembly.

5 Claims, 2 Drawing Sheets

INTEGRAL PIVOT DAMPER BLADE

This application is a continuation-in-part of application Ser. No. 07/667,875, filed Mar. 12, 1991 abandoned.

BACKGROUND OF THE INVENTION

1. Field of the Invention

The field of the invention is damper assemblies that include a set of damper blades which open and close similar to blinds or shutters to control the flow of air in heating, ventilating and air conditioning systems.

2. Description of the Background Art

Various air flow devices have been proposed with shutters that open to allow air to escape and which close to seal and prevent air from escaping at other times.

In typical damper blade designs of the prior art, as shown in Alley, U.S. Pat. No. 4,887,641 and Myers, No. 4,844,120, each damper blade has a transverse, V-shaped channel across its middle. A rod of cylindrical or other shape is clamped in this channel with added hardware, with the rod acting as the supporting member and the pivot axis for the damper blade. The ends of the rod extend beyond the ends of the damper blade and are journaled in holes in the frame for pivoting the damper blade.

It would be desirable to improve the efficiency of manufacturing of damper blades and damper blade assemblies while maintaining or improving performance. To reach these objectives, the present invention has been made.

SUMMARY OF THE INVENTION

The invention is incorporated in a damper blade of the type for a damper assembly in which a damper frame has sidewalls spaced apart, and the sidewalls form opposing openings for journaled support of the damper blade for pivoting movement around a transverse pivot axis extending between the opposing openings.

The damper blade comprises a planar body extending transversely between the sidewalls for rotation around the transverse pivot axis. The planar body has top and bottom edges and has sides extending between the top and bottom edges. A pair of journals are situated along opposite sides of the planar body, the journals each including a fixed portion extending along the pivot axis and along the body, and the journals each including two free end portions extending from the fixed portion in opposite directions, respectively, around the pivot axis, to form a respective arcuate journal bearing surface.

In a more specific aspect, the invention provides a rib of semicircular or other cross section, and the journals are formed in part as extensions of this rib, so that the pivot axis is positioned in the plane of the blade body.

The construction provides for convenient manufacturing from a blank without the addition of hardware for mounting the blade in a damper assembly.

The invention further provides a pair of low-friction bushings and extrusions formed around openings in the sidewalls of the damper assembly to support the damper blade and prolong the life of the journal bearing members. The integral pivots, low-friction bushings and extrusions provide an assembly with cost advantages over other designs which might use heavier gauge material for the damper blade and sidewall members.

Other objects and advantages, besides those discussed above, shall be apparent to those experienced in the art from the description of the preferred embodiment which follows. In the description, reference is made to the accompanying drawings, which form a part hereof, and which illustrate examples of the invention. Such examples, however, are not exhaustive of the various embodiments of the invention, and therefore reference is made to the claims which follow the description for determining the scope of the invention.

DETAILED DESCRIPTION OF THE PREFERRED EMBODIMENTS

Figure 1:
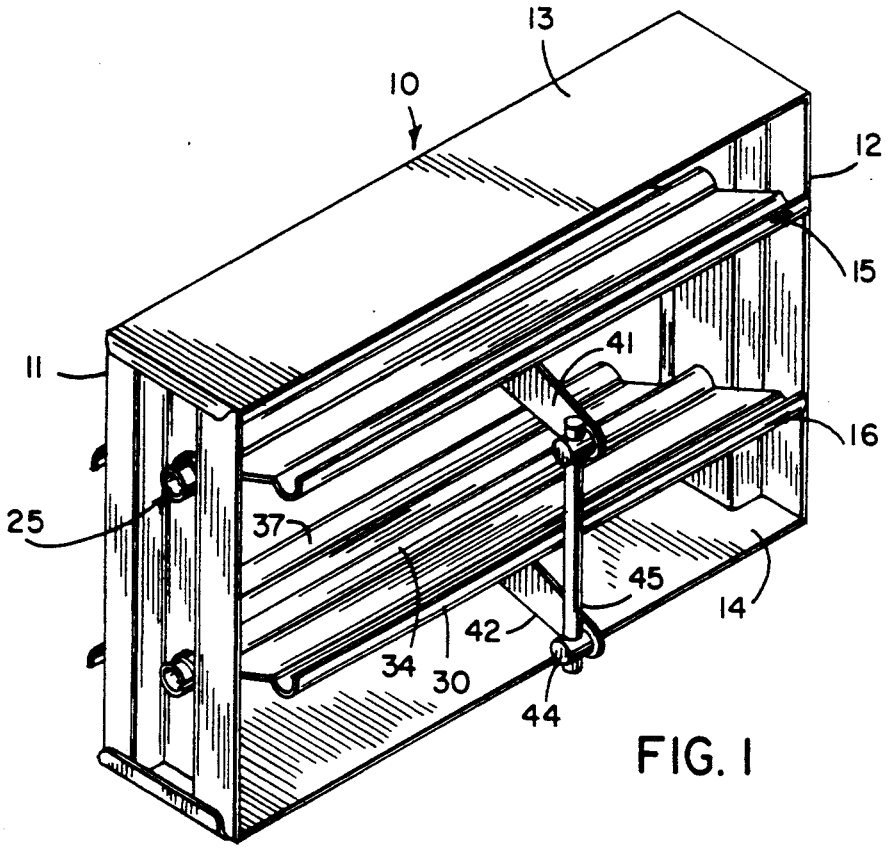
FIG. 1 is a perspective view of a damper assembly which incorporates the apparatus of the present invention.

Referring to FIG. 1, a damper assembly 10 includes a rectangular frame with left and right upright sidewalls 11, 12 spaced apart and connected by a laterally extending top frame member 13 and a laterally extending bottom frame member 14. A pair of damper blades 15,16 are pivotally mounted to the frame sidewalls 11,12 and are in the open position in FIG. 1.

Figure 4:
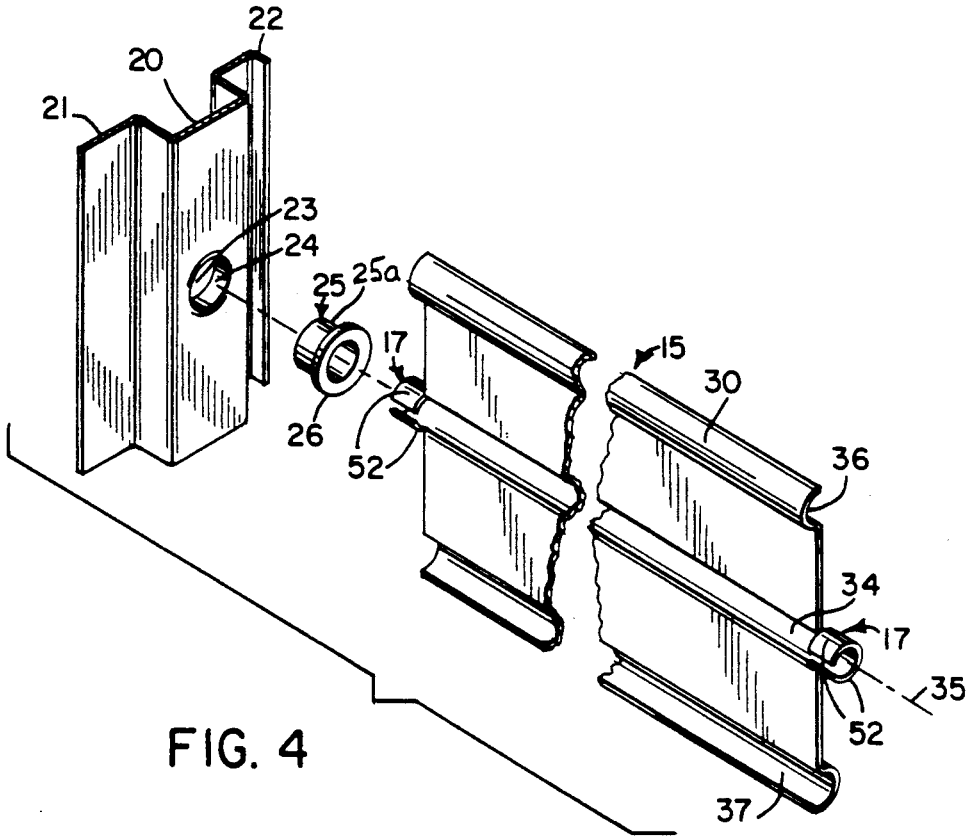
FIG. 4 is an exploded view in perspective of the blade apparatus of the present invention.

As seen best in FIG. 4, each sidewall 11,12 is formed with a rectilinear channel 20 running from top to bottom between two flanges 21,22. A journal opening 23 is formed in each channel 20 and encircled by a circular flange 24. A cylindrical bushing 25 with a cylindrical body portion **25*a* and with an annular lip 26 is inserted in each journal opening to receive a journal 17 of the damper blade 15,16**.

The bushings are made of a low-friction material, such as nylon. Nylon is the material preferred for lowest cost, but the bushings 25 can also suitably be made of Delrin® acetal, stainless steel or oil-impregnated bronze.

Each damper blade 15,16 has three round ribs 30,31,32, of semi-circular cross section, which extend transversely across the blade 15,16. The first round rib 30 extends along the top edge, the second round rib 31 traverses the blade midway between the top edge and the bottom edge, and the third round rib 32 extends along the bottom edge. The second rib 31 forms a rounded channel 34 in which a pivot axis 35 for the damper blade 15 is situated.

Figure 2:
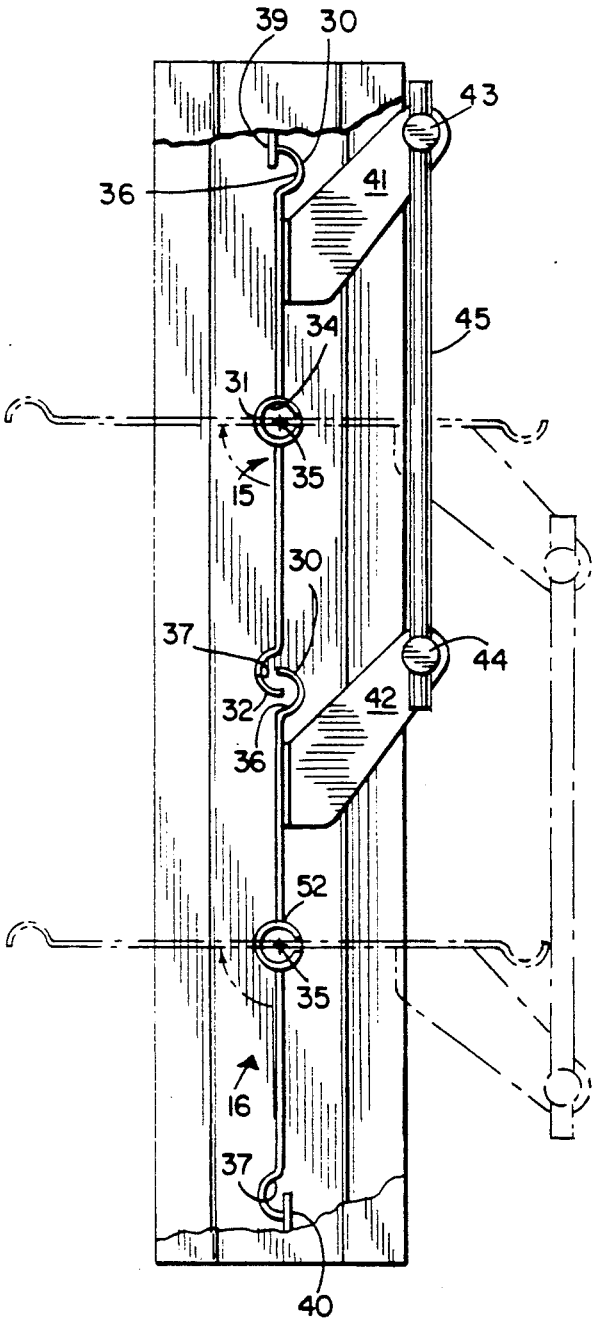
FIG. 2 is a side view in elevation with a sidewall broken away and showing the range of motion between a first position and a second position shown in phantom.

As seen in FIGS. 2 and 4, the first rib 30 forms a channel 36 that opens to the inside of the damper assembly 10 while the other channels 34,37 formed by ribs 31,32 open to the outside of the damper assembly 10. This allows the first channel 36 along the top edge of blade 16 to be received in the third channel 37 of the blade 15 positioned above it. The pivot axes 35 for the damper blades 15,16 intersect a substantially vertical centerline for the sidewalls 11,12. When the blades 15,16 are in the closed position, the first channel 36 on the top blade 15 abuts an angle flange 39 attached to the top frame member 13 and the third channel 37 on the bottom blade 16 abuts another angle flange 40 attached to the bottom frame member 14.

A pair of angle members 41,42 have flanges which are riveted or otherwise suitably attached to flat portions of the respective blades 15,16. These members have portions extending at an acute angle relative to the blades 15,16. The outside ends of angle members 41,42 are connected by pivot pins 43,44 to a vertical link 45 which couples the blades 15,16 together for opening and closing. When the link 45 is moved outward and downward, as illustrated in FIG. 2, the blades 15,16 are pivoted in a clockwise direction in FIG. 2, going as far as 90° to an open position.

Figure 3:
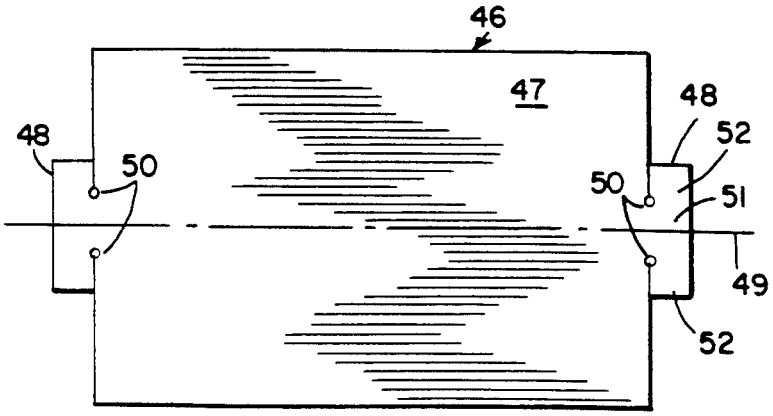
FIG. 3 is a blank before it is manufactured into the apparatus seen in FIG. 4.

As seen in FIG. 3, a damper blade 15 is advantageously formed from a blank 46 which is cut from strip stock. The blank 46 has a rectangular body portion 47 and rectangular ears 48 located symmetrically relative to a transverse axis 49. Four holes 50 are punched in the ears 48 at predetermined locations. Then, the ears 48 are slit inwardly from the top and bottom to the holes 50. The slitting operation provides fixed portions 51 between holes 50 and free end portions 52 extending upwardly and downwardly from holes 50. The blank 46 is then subjected to a forming operation in which the free end portions 52 are bent around dowels into arcuate extensions from the fixed portions 50 as seen in FIGS. 2 and 4. This not only results in the integral formation of journals 17 which are received in the bushings 25 to provide journal bearing surfaces, but in the preferred form of the damper blade 15, provides a pivot axis 35 at the radial center of the arc formed by the extensions 52.

Preferably, the center rib 31 is formed with a semicircular cross section by a press prior to forming the journals 17. The fixed portions 51 then also form arcuate portions of the journals 17. The center rib 31 shapes and strengthens the connection of the fixed portions 51 to the main body 47 of the blade 15. In other embodiments, it may be possible to form the center rib 31 and the journals 17 in a single roll forming operation.

This description has been by way of example of how the invention can be carried out. Those with experience in the art will recognize that various details may be modified in arriving at other detailed embodiments.

For example, the ears need not project in a transverse direction beyond the sides of the blade body 47, as long as separation is provided between the free end portions 52 and the blade body 47 to allow the free ends 52 to be bent into an arcuate shape. In the preferred embodiment the journals 17 are centered around an axis 35 in the plane of the largest portion of the blade 15, but this is not required in the broadest aspects of the invention. While the preferred journals are formed in an arcuate shape, other shapes such as rectangular or triangular may be employed in alternative embodiments. And while in the above example, the axis of rotation and center rib 32 are midway between the top edge and bottom edge of the blade 15, this is not required in the broadest aspects of the invention.

Therefore to apprise the public of the scope of the invention and the embodiments covered by the invention the following claims are made.

I claim:

1. A damper assembly comprising:

a pair of sidewalls spaced apart, the sidewalls having opposing openings and a damper blade for pivoting movement around a transverse pivot axis extending between the opposing openings, the damper blade comprising:

a planar body extending transversely between the sidewalls for rotation around the transverse pivot axis, the planar body having top and bottom edges and having sides extending between the top and bottom edges;

a pair of journals situated along opposite sides of the planar body, the journals each including a fixed portion extending substantially parallel to the pivot axis and extending from the body, and the journals each including two free end portions extending from the fixed portion in opposite directions, respectively, around the pivot axis, to define a respective journal bearing surface by which a respective side of the damper blade is supported in a respective one of the openings in the sidewalls;

wherein the damper assembly further comprises a pair of bushings each projecting laterally into a respective one of the opposing openings in the sidewalls, each bushing having a body portion with an opening situated within the opening in the respective sidewall for journaled support of a respective journal bearing surface of the damper blade, and each bushing having an annular flange disposed inwardly of a respective sidewall and encircling the opening in the body portion; and wherein the sidewalls each include an extrusion formed around a perimeter of each respective one of the opposing openings in the sidewalls to further support a respective journal bearing surface of the damper blade.

2. The damper assembly of claim 1 wherein the damper blade further comprises, a rounded rib formed in the body between the top and bottom edges and extending along the pivot axis, the rounded rib forming a channel in which the pivot axis is situated along a center of an arc defined by the rounded rib; and wherein the fixed portion of each journal is also rounded and wherein the fixed portion of each journal is an extension of the rounded rib.

3. The damper assembly of claim 1, wherein the two portions of each journal are arcuate with inside edges disposed adjacent to portions of the sides of the damper blade, the inside edges of the arcuate portions being separated from the planar body by a slit to allow bending of the arcuate portions relative to the fixed portion of the journal.

4. The damper assembly of claim 1, wherein the bushings are made of nylon.

5. A damper assembly comprising:

a pair of sidewalls spaced apart, the sidewalls having opposing openings and a damper blade for pivoting movement around a transverse pivot axis extending between the opposing openings, the damper blade comprising:

a planar body extending transversely between the sidewalls for rotation around the transverse pivot axis, the planar body having top and bottom edges and having sides extending between the top and bottom edges;

a pair of journals situated along opposite sides of the planar body, the journals each including a fixed portion extending substantially parallel to the pivot axis and extending from the body, and the journals each including two free end portions extending from the fixed portion in opposite directions, respectively, around the pivot axis, to define a respective journal bearing surface by which a respective side of the damper blade is supported in a respective one of the openings in the sidewalls;

wherein the sidewalls each form an extrusion around a perimeter of each respective one of the opposing openings in the sidewalls to support a respective journal bearing surface of the damper blade; and a pair of bushings each projecting laterally into an opening in a respective sidewall, each bushing having a body portion with an opening situated within the opening in the respective sidewall for journaled support of a respective journal bearing surface of the damper blade.

* * * * *